United States Patent [19]

McGlinchey

[11] 4,443,753

[45] Apr. 17, 1984

[54] SECOND ORDER TEMPERATURE COMPENSATED BAND CAP VOLTAGE REFERENCE

[75] Inventor: Gerard F. McGlinchey, Cupertino, Calif.

[73] Assignee: Advanced Micro Devices, Inc., Sunnyvale, Calif.

[21] Appl. No.: 295,952

[22] Filed: Aug. 24, 1981

[51] Int. Cl.³ ..... G05F 3/20

[52] U.S. Cl. ..... 323/313; 307/297; 323/315

[58] Field of Search ..... 307/296, 297; 323/313, 323/314, 315, 316

[56] References Cited

U.S. PATENT DOCUMENTS

| | | | |
|---|---|---|---|
| 4,064,448 | 12/1977 | Eatock | 323/313 X |
| 4,088,941 | 5/1978 | Wheatley, Jr. | 323/313 X |
| 4,249,122 | 2/1981 | Widlar | 323/313 |
| 4,250,445 | 2/1981 | Brokaw | 323/313 |
| 4,313,083 | 1/1982 | Gilbert et al. | 323/313 X |
| 4,325,018 | 4/1982 | Schade, Jr. | 323/313 |

*Primary Examiner*—William M. Shoop

*Attorney, Agent, or Firm*—Gary T. Aka

[57] ABSTRACT

A voltage reference circuit design which is temperature compensated to the second order is presented. The circuit comprises a sub-circuit for generating a bandgap voltage reference temperature compensated to the first order and a sub-circuit having a differential amplifier for generating a current having a second order temperature dependency. The current in turn is used for generating a correction voltage having a second order temperature dependency. The first order band gap voltage reference and the correction voltage are combined to provide the second order temperature compensated band gap voltage reference.

12 Claims, 3 Drawing Figures

SECOND ORDER TEMPERATURE COMPENSATED BAND CAP VOLTAGE REFERENCE

BACKGROUND OF THE INVENTION

1. Field of the Invention

This invention relates to band gap voltage reference circuits and, more particularly, to bandgap voltage reference circuits which are temperature compensated.

2. Description of the Prior Art

Voltage reference circuits have been designed based upon the transistor base-emitter voltage ($V_{BE}$) which can be expanded as follows:

$$V_{BE} = V_{GO}\left(1 - \frac{T}{T_o}\right) + V_{BEO} + n\frac{kT}{q}\ln\left(\frac{T_o}{T}\right) + \frac{kT}{q}\ln\left(\frac{I_C}{I_{CO}}\right)$$

where q is the charge of the electron;

k is Boltzmann's constant;

T is the absolute temperature;

$V_{GO}$ is the semiconductor bandgap voltage extrapolated to absolute zero temperature; $V_{GO}$ equals 1.240 V for silicon;

$V_{BEO}$ is the base-emitter voltage at an arbitrarily selected reference temperature To and at the corresponding reference collector current $I_{CO}$; and n is a parameter which depends upon the type of transistor and process used in manufacturing it.

This voltage, as shown expanded above and gathered into component terms of temperature dependency has a temperature independent term, $V_{GO}$, the semiconductor bandgap voltage extrapolated to absolute zero, a term having a first order temperature dependency (T), and a term having a second order temperature dependency (TlnT). The first order temperature dependency term, a much larger term than the second order temperature dependency term, is eliminated by using the differential in base-emitter voltages ($\Delta V_{BE}$) of two transistors operating at different current densities.

$$\Delta V_{BE} = \frac{kT}{q}\ln\frac{J_1}{J_2}$$

where J1 is the current density of the current through the base-emitter junction of the first transistor and J2 is the current density of the current through the base-emitter junction of the second transistor.

From an examination of the equation above, it can be seen that $\Delta V_{BE}$ is temperature dependent to the first order when the current density ratio J1/J2 is made independent of temperature.

By combining a base-emitter voltage and the differential in base-emitter voltages of two transistors operating at different current densities, a voltage reference having the temperature independent term and the second order term is realized. Heretofore, the second order dependency of such a voltage reference has been ignored, but most recently efforts have been made to eliminate such second order temperature dependency to achieve a temperature independent voltage reference.

One such effort is in U.S. Pat. No. 4,249,122 by Robert J. Wildlar, entitled TEMPERATURE COMPENSATED BANDGAP IC VOLTAGE REFERENCES and issued Feb. 3, 1981. The voltage reference circuit in this patent has a first voltage of the base-emitter voltage of a transistor and a second voltage based on the difference of the base-emitter voltages of two transistors operating at different current densities. The first and second voltage are combined to obtain a resulting voltage which is temperature compensated to the first order. To obtain second order compensation, additional circuitry which is temperature dependent, is used to modify the current densities of the two transistors which generate the difference in base-emitter voltages.

U.S. Pat. No. 4,250,445, entitled BANDGAP REFERENCE WITH CURVATURE CORRECTION, by Adrian P. Brokaw and issued Feb. 10, 1981, discloses another voltage reference circuit having temperature compensation beyond the first order. This circuit employs two transistors operating at different current densities to develop a base-emitter differential voltage. This voltage is combined with a base-emitter voltage of a transistor to attain a first order temperature compensated reference as discussed previously. The improvement lies in a resistor having a certain temperature dependent characteristics so that when the resistor is connected in series with the first order temperature compensated circuit, the second order temperature dependent voltage components are compensated for and the resulting voltage reference has better than first order temperature compensation.

These are some of the more recent efforts to achieve a voltage reference compensated to the second order.

SUMMARY OF THE INVENTION

The present invention solves this problem of a temperature independent voltage reference by the bandgap voltage reference in which second order temperature dependence is fully compensated in a novel and superior manner over these recent efforts.

To achieve this, the present invention provides for means for generating the bandgap reference temperature compensated to the first order, the voltage reference of a component voltage having a second order temperature dependency, means for generating a current having a second order temperature dependency as the component voltage, means responsive to the current for generating a correction voltage having the second order temperature dependency and means for combining the first order temperature compensated bandgap voltage reference and the correction voltage so that the component voltage is cancelled, whereby the combined voltage reference and the correction voltage provide a second order temperature compensated bandgap voltage reference.

The current generation means has a differential amplifier with a transconductance independent of temperature. The differential input signal to the amplifier is formed by the difference in base-emitter voltages of a first and second diode-connected transistors. The first diode-connected transistor operates with a first current dependent upon temperature to the first order and the second diode-connected transistor operates with a second current independent of temperature so as to make the amplifier output current dependent upon temperature with a second order relationship (TlnT).

The amplifier output current is passed through a resistance element to generate the correction voltage, which retains the same second order temperature dependency as the output current. When the correction voltage is combined with the first order temperature compensated voltage reference, the component voltage of second order temperature dependency is cancelled and a second order temperature compensated voltage results.

The voltage reference herein is best realized in an integrated circuit and is designed to take full advantage of the particular characteristics of integrated circuit technology.

BRIEF DESCRIPTION OF THE DRAWINGS

An understanding of the invention can be furthered by a reading of the Detailed Description of the invention and by reference to the following drawings.

DETAILED DESCRIPTION

In the following explanation, the base currents of the transistors will largely be ignored. This is consistent with transistors having large $\beta$'s, which is easily and commonly manufactured in integrated circuits. Also, in critical circuit areas detailed analysis shows that the transistor base currents nearly cancel each other to yield a small residual current error which can be neglected. Thus, a transistor in operation has most of its current flowing through its emitter-collector current path and very little contribution from its base current.

The temperature variation of resistances in the circuit is ignored since all voltages depend upon the ratio of resistance values, which is temperature independent.

Figure 1:
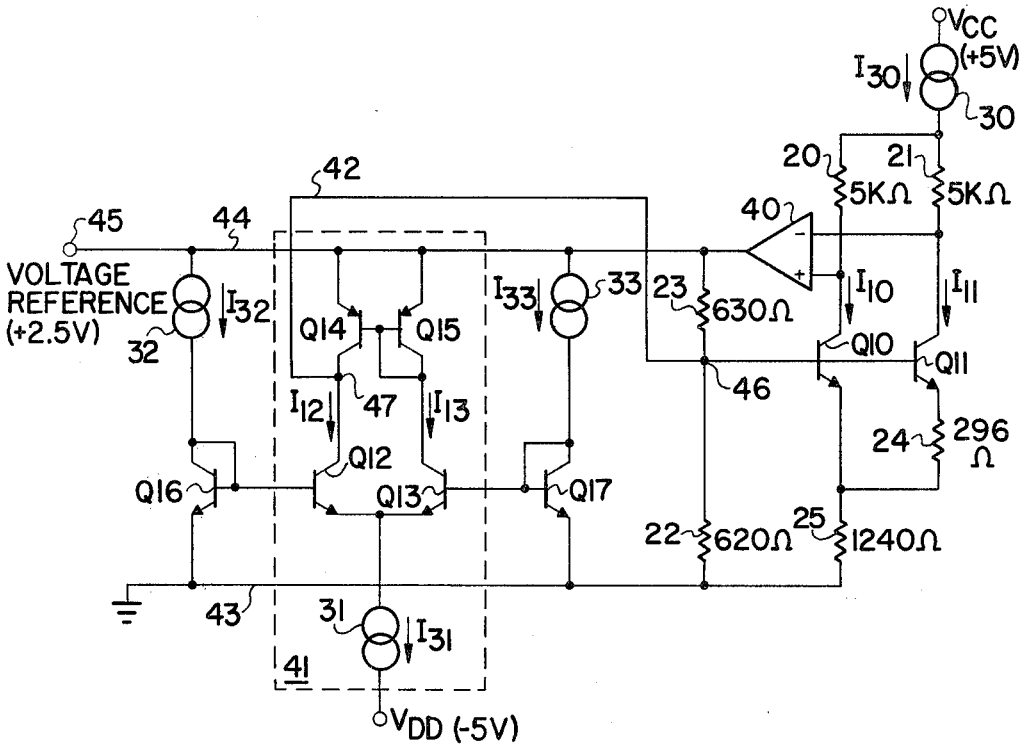
FIG. 1 is a schematic diagram of one embodiment of the present invention having temperature dependency compensated to the second order.

FIG. 1 is a circuit schematic of an embodiment of the present invention. The transistors Q10 and Q11 generate a first order temperature compensated voltage reference. The collectors of the two transistors Q10, Q11 are connected to a current source 30 which is connected to a voltage source terminal held at voltage $V_{CC}$, here indicated to be at a positive 5 volts. The current source 30 supplies equal currents to each of the two transistors through equal resistance elements 20 and 21. The two transistors Q10 and Q11 have their bases connected together so that the difference in their base-emitter voltages, $\Delta V_{BE}$ appears across the resistance element 24. This relations appears as $$\Delta V_{BE} = V_{BE10} - V_{BE11} = I_{11}R_{24}$$

where $V_{BE10}$ is the base-emitter voltage of the transistor Q10;

$V_{BE11}$ is the base-emitter voltage of the transistor Q11;

$I_{11}$ is the collector current of the transistor Q11; and $R_{24}$ is the resistance of the element 24.

The difference in base-emitter voltages is determined by setting the current densities at which the two transistors Q10, Q11 operate. In the present embodiment, this is done by scaling the transistor Q11 to be ten times larger than that of the transistor Q10. Since the transistor Q11 has an area ten times larger, its transistor current density $J_{11}$ is ten times less than the current density $J_{10}$ of the transistor Q10. Thus, the equation above reduces to $$I_{11}R_{24} = \frac{kT}{q} \ln \frac{J_{10}}{J_{11}}$$

$$I_{11} = \frac{kT}{qR_{24}} \ln 10$$

Since $I_{11}$, the current through the transistor Q11 is equal to the current $I_{10}$, the current through the transistor Q10, the voltage across the resistance element 25 is $2I_{11}$ times the resistance of the element 25. This reduces to $$2\frac{kT}{q} \frac{R_{25}}{R_{24}} \ln 10,$$

where $R_{24}$ and $R_{25}$ are respectively the resistances of the elements 24 and 25.

The voltage of the base electrode of the transistor Q10 is the base-emitter voltage of the transistor Q10 and the difference in base-emitter of the transistors Q10 and Q11 generated across the resistance element 25. This voltage sum, $V_{(1)}$ is $$V_{(1)} = V_{BE10} + \frac{2kT}{q} \frac{R_{25}}{R_{24}} \ln 10$$

Putting in the terms for $V_{BE}$ $$V_{(1)} = V_{GO}\left(1 - \frac{T}{T_o}\right) + V_{BEO}\left(\frac{T}{T_o}\right) + \frac{nkT}{q} \ln\left(\frac{T_o}{T}\right) + \frac{kT}{q} \ln\left(\frac{I_{10}}{I_{CO10}}\right) + \frac{2kT}{q} \frac{R_{25}}{R_{24}} \ln 10$$

Since $I_{10} = I_{11}$ which, in turn, is proportional to temperature as derived above, $V_{(1)}$ can be separated into zero, first and second order terms of temperature dependency.

$$V_{(1)} = V_{GO} - (V_{GO} - V_{BEO})\left(\frac{T}{T_o}\right) + C_1 \frac{kT}{q} \ln\left(\frac{T_o}{T}\right) + \frac{2kT}{q} \frac{R_{25}}{R_{24}} \ln 10$$

where $R_{25}$ is chosen to make $$\frac{2k}{q} \frac{R_{25}}{R_{24}} \ln 10$$

equal to $(V_{GO} - V_{BEO})/T_O$ and the constant $C_1$ includes the structure-process factor n and parameters from the $$\frac{kT}{q} \ln\left(\frac{I_{10}}{I_{CO10}}\right)$$

term.

The ratio of the two elements 24 and 25 are set so that the first order temperature terms cancel each other out. In one embodiment of the invention, the resistor ratio is set by forming the resistor 25 out of resistors shorted by metal link fuses which are melted to trim the resistance of the element 25 so that resistance ratio is set to the desired value.

It should be noted that when the voltage reference circuit has been implemented in integrated circuit form with particular processing steps, the values of $C_1$ are easy to determine empirically. The variations between values are small, less than 10 percent, for different batches of processed integrated circuits so as to not to require repetitious determination of $C_1$.

Thus $V_{(1)}$ is compensated to the first order and becomes $$V_{(1)} = V_{GO} + C_1 \frac{kT}{q} \ln\left(\frac{T_o}{T}\right).$$

It is this voltage which appears at the node 46 and is modified by a second order temperature dependent correction voltage. This correction voltage is determined so as to cancel the $$C_1 \frac{kT}{q} \ln\left(\frac{T_o}{T}\right)$$

term so as to make the node 46 voltage temperature independent.

The correction voltage is supplied by a current through a line 42 connected to the node 46. The current by a second order relationship (TlnT) is driven to, or drawn from the node 46, depending upon temperature.

This current is generated by a differential amplifier 41, enclosed by a dotted line in a rectangular shape. The input signals to the differential amplifier 41 are received by the base electrodes of the transistors Q12, Q13 which are respectively connected to diode-connected transistors Q16, Q17 having their emitters connected to a grounding line 43. The difference in voltages between the base electrodes of the equal dimensional transistors Q16, Q17 is the input signal to the differential amplifier 41. This differential input voltage $\Delta V_{IN}$ is the difference between the base-emitter voltage of the transistor Q16 and the base-emitter voltage of the transistor Q17.

$$V_{IN} = V_{BE16} - V_{BE17}$$

But the base-emitter voltage of transistor Q16 is related to the current at which the transistor is operating at, i.e., its collector current $I_{32}$ generated by a current source 32. Similarly, the base-emitter voltage of the transistor Q17 is related to the collector current $I_{33}$ from the current source 33. Thus, by the base-emitter voltage equation above for a transistor and by the equality in the constants $I_{CO}$ for the transistor Q16, Q17

$$\Delta V_{IN} = \frac{kT}{q} \ln \frac{I_{32}}{I_{CO}} \cdot \frac{I_{CO}}{I_{33}} = \frac{kT}{q} \ln \frac{I_{32}}{I_{33}}$$

The current source 32 is designed so that its output current $I_{32}$ has a first order temperature dependency.

$$I_{32} = 2 \frac{kT}{qR_{74}} \ln 10$$

In contrast to this, the current source 33 is designed so that its output current $I_{33}$ is independent of temperature.

$$I_{33} = V_{REF}/R_{26}$$

where $V_{REF}$ is the constant and predetermined output voltage reference of the circuit. $\Delta V_{IN}$ becomes:

$$\Delta V_{IN} = \frac{kT}{q} \ln\left[\frac{2kT}{qR_{74}} \ln(10) \frac{R_{26}}{V_{REF}}\right] = \frac{kT}{q} \ln\left[\frac{2k}{qV_{REF}} \ln 10 \left(\frac{R_{26}}{R_{24}}\right) T\right]$$

The designs of these two current sources are discussed later. What is significant is that the input signal to the differential amplifier 41 is of the form TlnT, a term of second order temperature dependency.

In the differential amplifier 41 the emitter electrode of the transistor Q12 is connected to the emitter electrode of transistor Q13 having its base electrode connected to the base electrode of the transistor Q17. The emitter electrodes of the two transistors Q12 and Q13 are connected to a current source 31 generating a current $I_{31}$. The current source is further connected to a voltage source terminal held at $V_{DD}$. In this embodiment $V_{DD}$ is a minus 5 volts. The current supplied by the current souce 31 is shared between the two transistors Q12, Q13.

Since the base electrodes of the transistors Q13 and Q17 are connected together, the transistor Q13 operates at a current $I_{13}$, responsive to the current $I_{33}$. The collector electrode of the transistor Q13 is connected to an input terminal of a current mirror formed by two PNP transistors, Q14 and Q15, which have their base electrodes coupled. The emitter electrodes of the two transistors are connected to the output line 44 of the circuit and the collector electrode of the diode-connected transistor Q15 is connected to the collector electrode of the transistor Q13. Operationally, the current drawn through the collector electrode of the transistor Q14 tracks the collector current of the transistor Q15. Thus, the output current of the current mirror, i.e., the current through collector electrode of the transistor Q14, is equal to $I_{13}$.

On the other hand, the transistor Q12 is responsive to the transistor Q16 operating current $I_{32}$, which is temperature dependent to the first order. The output of the differential amplifier 41, the current $I_{out}$ on the output line 42 which is connected to the collector electrodes of the transistors Q14 and Q12 at a node 47, is dependent upon the difference in voltages upon the electrodes of the bases of the transistors Q12 and Q13, $\Delta V_{IN}$. First, assuming that the circuit is at a temperature, say, room temperature of 300 degrees Celsius, so that both currents $I_{32}$ and $I_{33}$ are equal. Since both currents are equal, the same voltage is generated by the transistors Q16 and Q17, thus making $\Delta V_{IN}$ equal to zero. The transistors Q12 and Q13 share the current $I_{31}$ equally. Now assume that the ambient temperature of the circuit changes so that $\Delta V_{IN}$ is not equal to zero. Since the transistor Q12 is part of a differential pair, the change in its input voltage can be considered $\Delta V_{IN}/2$. It is well known that the transconductance $g_m$ of a transistor is $$g_m = \frac{I_C}{\frac{kT}{q}}$$

and where the emitter current $I_E$ is nearly the same as the collector current $I_C$ as is assumed for these transistors, $$g_m = \frac{I_E}{\frac{kT}{q}}$$

$$g_m = \frac{I_{31}}{2\frac{kT}{q}}$$

for the transistors Q12, Q13. The change in input voltage to the transistor Q12 leads to a change in the collector current.

$$\Delta I_C = g_m\left(\frac{\Delta V_{IN}}{2}\right)$$

Now, the other portion of the input signal is upon the base electrode of the transistor Q13. By the same analysis as for the transistor Q12, the change in the collector current of the transistor Q13 is also $$\Delta I_c = g_m(\Delta V_{IN}/2)$$

However, by the current mirror formed by the transistors Q14 and Q15, the same magnitude current will appear upon the collector electrode of the transistor Q14 as on the collector electrode of the transistor Q15. Thus the sum of the two changes in collector current for the transistors Q12 and Q13 is the additional current which must appear on the output line 42 and that the input-output relationship of the differential amplifier as a whole is $$I_{OUT} = 2\Delta I_C = g_m \Delta V_{IN}$$

$$I_{OUT} = \left(\frac{I_{31}}{2\frac{kT}{q}}\right)\Delta V_{IN}$$

The current source 31 which generates $I_{31}$ is designed so that it has a first order temperature dependency so as to make the transconductance on the amplifier 41 independent of temperature. This is achieved by the use of the difference in base-emitters voltages between two transistors operating at different current densities, as discussed previously.

$$I_{31} = \frac{6}{5}\ \frac{kT}{qR_{74}} \ln 10$$

Substituting these terms for $I_{31}$, $I_{32}$, $I_{33}$ into the equation for $I_{OUT}$, $$I_{OUT} = \frac{6}{5}\ \frac{1}{R_{74}} \ln 10 \frac{kT}{q} \ln\left[\frac{2kT\ln 10}{qV_{REF}}\left(\frac{R_{26}}{R_{74}}\right)\right]$$

-continued $$I_{OUT} = \frac{C_2}{R_{74}}\ \frac{kT}{q} \ln \frac{T}{T_O}$$

where $(R_{26}/R_{74})$ are set to make the parameters within the brackets equal to the particular $T_O$ selected and $C_2$ represents $$\frac{6}{5}\ \frac{k}{q} \ln 10.$$

It should be noted that the current has a second order temperature dependency like that of the second ordered term in the base emitter voltage of a transistor, a TlnT temperature dependency. The output line 42 is connected to the summing node 46. Thus this current $I_{OUT}$ modifies the original voltage supplied by the base electrodes of the two transistors Q10 and Q11 by driving a small additional current through the resistors 22,23 to generate a small correction voltage.

By small signal analysis, the correction voltage is simply $$I_{OUT}R_x = C_2\frac{R_x}{R_{74}}\ \frac{kT}{q} \ln \frac{T}{T_O}$$

where $R_x$ is the resistance of elements 22 and 23 in parallel. The true voltage at the node 46 is $$V_{(1)} + I_{OUT}R_x = V_{GO} + C_1\frac{kT}{q}\ln\left(\frac{T_O}{T}\right) + C_2\frac{R_x}{R_{74}}\ \frac{kT}{q}\ln\left(\frac{T}{T_O}\right)$$

$$= V_{GO} - C_1\frac{kT}{q}\ln\left(\frac{T}{T_O}\right) + C_2\frac{R_x}{R_{74}}\ \frac{kT}{q}\ln\left(\frac{T}{T_O}\right)$$

By setting $C_1 = C_2R_x/R_{74}$, the voltage at the node 46 is $V_{GO}$, a temperature independent constant. The parameters which determine the magnitude of $I_{OUT}$ are set so as to be the same as for the second order temperature dependent term generated by the two transistors Q10 and Q11. In this manner, the voltage at the node 46 is fully temperature compensated.

In a strict sense, the correction voltage modifies the voltage on the base electrodes of the transistor Q10, Q11 requiring a reiterative feedback calculation for the circuit. However, the correction voltage is very small compared to the first order temperature compensated voltage from the transistor Q10, Q11. For example, the maximum output current for the differential amplifier 41 is approximately 240 μA. This implies a maximum correction voltage of 75 mV compared to a voltage of 1.2 V from the transistors Q10, Q11. The correction voltage and the first order compensated voltage can be considered independent from each other and that the two voltages combine additively.

For the present embodiment, it is desired that the voltage reference not be set at the extrapolated bandgap voltage $V_{GO}$ (which equals 1.240 V for silicon transistors), but to be set at approximately twice $V_{GO}$. This is done by using the resistance elements 22, 23, with a feedback differential amplifier 40 which has its input terminals each respectively connected one of the collector electrodes of the transistors Q10 and Q11. The amplifier 40 forces the two collector currents $I_{10}$ and $I_{11}$ to be equal which had been assumed in the explanation earlier. The two resistance elements 22, 23 from an inverse voltage divider circuit, a voltage multiplier circuit. The voltage 1.240 V at the node 46 is multiplied by the (630+620)/620, where the 630 ohms and 620 ohms are the respective resistances for the elements 23 and 22. This multiplied voltage is the output voltage of the amplifier 40.

In this manner the output terminal 45 of the circuit achieves a voltage reference $V_{REF}$ of nearly positive 2.5 volts which is compensated to the second order.

Figure 2:
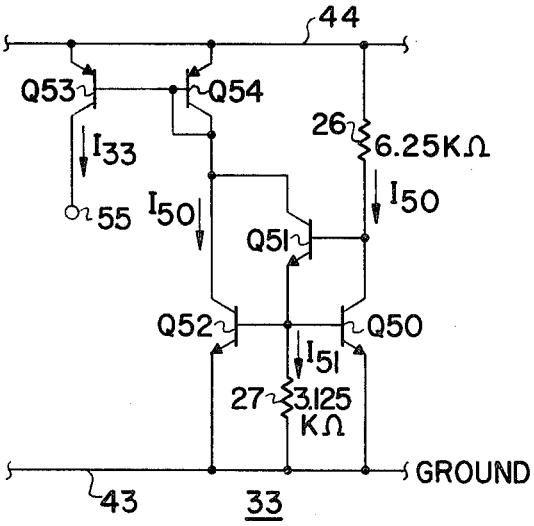
FIG. 2 is a schematic diagram of a novel temperature independent current generator used in a portion of the circuit shown in FIG. 1.

FIG. 2 is a detailed circuit schematic of the temperature independent current generator 33. A transistor Q50 has its emitter electrode connected to the grounding line 43 and has its collector electrode connected to the output line 44 through a resistance element 26. A second transistor Q51 is also connected to the ground line 43 through a second resistor 27 and is further connected to the base electrode of the transistor Q50. The base electrode of the transistor Q51 is connected to the collector electrode of the transistor Q50 which determines a current through the resistance element 26. This current is $(V_{REF}-2V_{BE})/R_{26}$, where $R_{26}$ is the resistance of the element 26. Furthermore, there is a second current $I_{51}$ through the resistance element 27 which has exactly one-half the resistance to that of the element 26.

$$I_{51}=V_{BE}/R_{27}=2V_{BE}/R_{26},$$

where $R_{27}=R_{26}/2$

A transistor Q52 has its emitter electrode connected to the ground line 43 and its base electrode connected to the base electrode of the transistor Q50, thereby making the base-emitter voltage of the transistor Q52 equal to that of the transistor Q50. The transistor Q52 thus tracks the transistor Q50 so that the collector current of the transistor Q52 is equal to the current $I_{50}$ through the transistor Q50. This is shown by arrows in FIG. 2. A collector electrode of the transistor Q51 is also connected to the collector electrode of the transistor Q52.

The two currents, $I_{50}$ and $I_{51}$, are drawn through an input terminal of a current mirror formed by two PNP transistors Q53, Q54. The input terminal of the current mirror is formed by the collector electrode of the transistor Q54 which is in a diode-connected mode, having its base and collector coupled. The emitter of the transistor Q54 is connected to the output line 44. The base electrode of the transistor Q54 is connected to the base electrode of the transistor Q53, which has its emitter electrode connected to the output line 44 and its collector electrode connected to an output terminal 55 of the current source 33. The output current $I_{33}$ is the sum of the two currents through the input terminal of the current mirror. Thus the output current of the current source 33 is $V_{REF}/R_{26}$ where $R_{26}$ is the resistance of the element 26. The output current $I_{33}$ is temperature independent.

Figure 3:
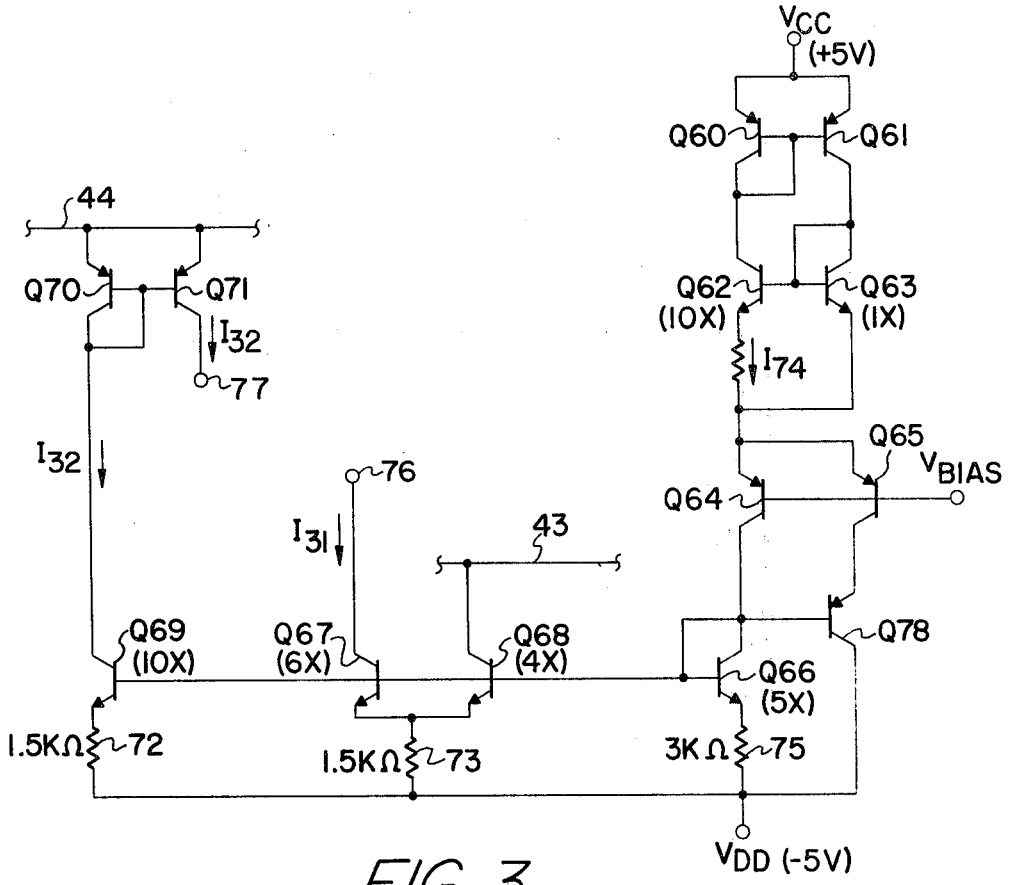
FIG. 3 is a schematic diagram of a circuit generating temperature dependent currents used in the circuit shown in FIG. 1.

A particular circuit implementation of the current sources 31,32 is illustrated in FIG. 3. These first order temperature dependent current sources are based upon the difference in base-emitter voltages of two transistors.

Two PNP transistors Q60, Q61 supply equal currents to the collector electrodes of two NPN transistors Q62, Q63 having their base electrodes connected together. The transistor Q62 is 10 times larger than the transistor Q63, which is in a diode-connected mode. As explained previously concerning the operation of transistors Q10, Q11 in FIG. 1, the current $I_{74}$ through the resistance element 74 connected directly to the emitter electrode of the transistor Q62 is proportional to the difference in base-emitter voltages of the two transistors Q62, Q63. This current is $$I_{74}=\frac{1}{R_{74}}\ \frac{kT}{q}\ \ln 10$$

where $R_{74}$ is the resistance of the element 74 and is set so that $I_{74}$ is approximately 200 $\mu$A.

Since the transistor Q63 is connected in parallel to the transistor Q62, the transistor Q63 also approximately contributes a current of 200 $\mu$A. The total current from the two transistors Q62, Q63 to the two transistors Q64, Q65 is therefore $2I_{74}$.

The two PNP transistors Q64, Q65 have their parallel-connected emitter electrodes connected to the emitter electrodes of the transistor Q62 (through element 74) and the transistor Q63. The transistors Q64, Q65 have their base electrodes connected together to a biased voltage, $V_{BIAS}$, source so that base-emitter voltages of the two transistors are equal. (For optimal operation $V_{BIAS}$ is about three diode voltage drops below $V_{CC}$, i.e., +2.9 volts.) The current $2I_{74}$ is shared equally between the transistors Q64, Q65. The transistor Q65 has its collector electrode connected to the emitter electrode of a PNP transistor Q78. The other half of current, $I_{74}$, passes through the collector electrode of the transistor Q64.

The collector electrode of a diode-connected transistor Q66 is connected to the transistor Q64 collector electrode. However, PNP transistors have much lower $\beta$'s than NPN transistors and a significant fraction of the PNP emitter current is diverted into the base current of the transistor. To compensate for the loss of current through the base electrode of the PNP transistor Q64, the PNP transistor Q78 injects its base current to the collector electrode of the transistor Q66 in order that the diode-connected transistor truly receives the full current $I_{74}$. The emitter electrode of the transistor Q66 is connected through a resistance element 75 to the second voltage source at $V_{DD}$.

Three transistors Q67, Q68, Q69 are similarly connected to the transistor Q66. Each has its base electrode connected to the base electrode of the transistor Q66 and has ite emitter electrode connected to the second voltage source through a resistance element. The currents generated through these transistors are thus dependent upon the operating current $I_{74}$ of the transistor Q66.

The emitter electrodes of the two transistors Q67, Q68 share a resistance element 73. The resistance of element 73 is one-half of that element 75. This implies that the sum total of currents through both transistors Q67, Q68 is twice the current through the transistor Q66. However, the transistors Q67, Q68 are scaled in size with respect to each other (transistor Q67 is six times the standard transistor size of the circuit while the transistor Q68 is 4 times standard size). Since the two transistors are so coupled that their base-emitter voltages and, therefore, operating current densities, are equal, the transistors Q67, Q68 have 6/10 and 4/10 of the total current sum, respectively. The collector electrode of the transistor Q68 is connected to the grounding line 43; the collector electrode of the transistor Q67 is connected to the output terminal 76 of the current source 31.

$$I_{31} = \frac{6}{10} \cdot 2I_{74}$$

$$I_{31} = \frac{6}{5} \frac{kT}{R_{74}q} \ln 10$$

This confirms the value used for $I_{31}$ in the explanation earlier.

The transistor Q69 operates at a current $I_{32}$ twice the current through the transistor Q66, since the resistance of the element 72 is one-half that of element 75. A current mirror formed by two PNP transistor Q70, Q71 ensures that the source magnitude current is generated through the output terminal of the current source 32 as that flowing through the collector electrode of the transistor Q69. As stated previously, this current $I_{32}$ is $$I_{32} = 2I_{74}$$

$$I_{32} = 2\frac{kT}{qR_{74}} \ln 10$$

It should be noted that while the present embodiment of the invention has been described with respect to NPN transistors, except for the current mirrors which are formed by PNP transistors, it is within the capability of one skilled in the art to redesign the present invention by reversing the polarities of the transistors and modifying the particular voltages.

Accordingly, while the invention has been particularly shown and described with reference to the preferred embodiments, it would be understood by those skilled in the art that changes in form and details may be made therein without departing from the spirit of the invention. It is therefore intended that an exclusive right be granted to the invention as limited only by the metes and bounds of the appended claims.

What is claimed is:

1. A voltage reference circuit comprising means for generating a bandgap voltage reference temperature compensated to the first order, said voltage reference having a component voltage having a second order temperature dependency, means for generating a current having a second order temperature dependency as said component voltage, means responsive to said current for generating a correction voltage having said second order temperature dependency, means for combining said first order temperature compensated bandgap voltage reference and said correction voltage so as to cancel said component voltage, whereby said combined voltage reference and said correction voltage provide a second order temperature compensated bandgap voltage reference.

2. A circuit as in claim 1 wherein said first order temperature compensated voltage reference generation means further comprises means for summing a first voltage formed by the base-emitter voltage of a transistor and a second voltage formed by the difference in base-emitter voltages of two transistors operating at different current densities.

3. A circuit as in claim 1 wherein said current generation means further comprises a differential amplifier having a transconductance independent of temperature, and having a differential input signal formed by the difference in P-N junction voltages of a first diode means and a second diode means.

4. A circuit as in claim 3 wherein said first diode means operates with a first current dependent upon temperature to the first order and said second diode means operates with a second current independent of temperature.

5. A circuit as in claim 4 wherein said first and second diode means each comprise a diode-connected transistor.

6. A voltage reference circuit comprising means for generating a first voltage formed by the base-emitter voltage of a transistor and a second voltage formed by the difference in base-emitter voltages of two transistors operating at different current densities, a differential amplifier responsive to the difference in base-emitter voltages of a first diode-connected transistor operating with a first current and a second diode-connected transistor operating with a second current, and having a transconductance independent of temperature so that said amplifier generates an output current proportional to said difference in base-emitter voltages of said first and second diode-connected transistors, means responsive to said output current for generating a correction voltage, means for combining said first and second and correction voltages whereby said combined voltages provide a second order temperature compensated bandgap voltage reference.

7. A circuit as in claim 6 wherein said first current is proportional to the difference of the base-emitter voltages of two transistors operating at different current densities so that said first current is dependent upon temperature to the first order, and said second current is constant so that said second current is independent of temperature.

8. A circuit as in claim 7 wherein said differential amplifier further comprises first and second transistor having emitter terminals coupled together to a third current source, base terminals of said first and second transistors forming first and second input terminals respectively to said differential amplifier, said first input terminal connected to a base terminal of said first diode-connected transistor and said second input terminal connected to a base terminal of said second diode-connected terminal, means having an input terminal connected to a collector terminal of said second transistor and an output terminal connected to a collector terminal of said second transistor and an output terminal connected to a collector terminal of said first transistor, said means responsive to said second transistor collector current for generating a mirror current through said output terminal, an amplifier output terminal connected to said collector terminal of said first transistor so that said amplifier output current is determined by the difference between said first transistor collector current and said mirror current.

9. A circuit as in claim 8 wherein said third current is proportioned to the difference of the base-emitter voltages operating at different current densities, whereby the transconductance of said differential amplifier is independent of temperature.

10. A circuit as in claim 9 wherein said current mirror means further comprises third and fourth transistors having emitter terminals connected to a voltage source, a base terminal of said fourth transistor connected to a collector terminal of said fourth transistor, said fourth transistor collector terminal forming said current mirror means input terminal, a base terminal of said third transistor connected to said fourth transistor base terminal, a collector terminal of said third transistor forming said current mirror means output terminal.

11. A circuit as in claim 8 wherein said second current is generated by a temperature independent generator comprising a first transistor having an emitter electrode connected to a fixed voltage source terminal, and a collector electrode connected by a first resistance means to an output terminal of said voltage reference circuit, a second transistor having an emitter electrode connected to said fixed voltage source terminal by a second resistance means, said emitter electrode further connected to a base electrode of said first transistor, and a base electrode connected to said first transistor collector electrode so that a first generator current is driven through said first resistance means and a second generator current is driven through said second resistance means, means for generating said second current responsive to said first and second generator currents combined.

12. A circuit as in claim 11 wherein said second current generating means comprises a third transistor having an emitter electrode connected to said fixed voltage source terminal, a base terminal connected to said first transistor base terminal so that a current equivalent to said first generator current is driven through a collector electrode of said third transistor, means, having an input terminal connected to a collector electrode of said second transistor and to said third transistor collector electrode, for generating a current mirror to said equivalent first generator current and to said second generator current through an output terminal, whereby said output terminal current defines said second current.

* * * * *

UNITED STATES PATENT AND TRADEMARK OFFICE

CERTIFICATE OF CORRECTION

PATENT NO. : 4,443,753

DATED : April 17, 1984

INVENTOR(S) : Gerald F. McGlinchey

It is certified that error appears in the above-identified patent and that said Letters Patent is hereby corrected as shown below:

The title should read:

-- SECOND ORDER TEMPERATURE COMPENSATED BAND GAP VOLTAGE REFERENCE --

Signed and Sealed this

*Third* Day of *September 1985*

[SEAL]

*Attest:*

DONALD J. QUIGG

*Attesting Officer* *Acting Commissioner of Patents and Trademarks - Designate*